US008369749B2

(12) United States Patent
Nakasha

(10) Patent No.: US 8,369,749 B2
(45) Date of Patent: Feb. 5, 2013

(54) DEVELOPING DEVICE AND IMAGE FORMING DEVICE

(75) Inventor: Shinya Nakasha, Tokyo (JP)

(73) Assignee: Oki Data Corporation, Tokyo (JP)

( * ) Notice: Subject to any disclaimer, the term of this patent is extended or adjusted under 35 U.S.C. 154(b) by 428 days.

(21) Appl. No.: 12/691,994

(22) Filed: Jan. 22, 2010

(65) Prior Publication Data

US 2010/0189468 A1 Jul. 29, 2010

(30) Foreign Application Priority Data

Jan. 26, 2009 (JP) ..... 2009-013763

(51) Int. Cl.
*G03G 15/08* (2006.01)

(52) U.S. Cl. ..... 399/252; 399/106

(58) Field of Classification Search ..... 399/252, 399/102, 103, 106
See application file for complete search history.

(56) References Cited

U.S. PATENT DOCUMENTS 6,002,903 A * 12/1999 Hayase et al. ..... 430/45.54
6,009,287 A * 12/1999 Goldie ..... 399/103

FOREIGN PATENT DOCUMENTS

JP 2002236389 A * 8/2002
JP A-2002-328525 11/2002
JP A-2005-316507 11/2005

* cited by examiner

*Primary Examiner* — David Gray
*Assistant Examiner* — Andrew Do
(74) *Attorney, Agent, or Firm* — Posz Law Group, PLC

(57) ABSTRACT

A developing device includes a developing member for developing an electrostatic latent image by adhering developer on an image carrier; a feeding member for feeding the developer to the developing member; and an interposing member that is interposed between the developing member and the feeding member during a period of when the developing device is not being used.

4 Claims, 5 Drawing Sheets

DEVELOPING DEVICE AND IMAGE FORMING DEVICE

CROSS REFERENCE

The present application is related to, claims priority from and incorporates by reference Japanese patent application number 2009-013763, filed on Jan. 26, 2009.

TECHNICAL FIELD

The present invention relates to a developing device to avoid spot caused by agglomeration of externally added agent added to toner and an image forming device using the developing device.

BACKGROUND

Japanese laid-open patent publication number 2002-328525 discloses an image forming device, such as a copier, a printer or a facsimile machine, that uses an electrographic method. The image forming device has a developing device, which supplies a developer to an electrostatic latent image formed on a latent image carrier, and develops the latent image as a developer image. Some of these kinds of developing devices use a developer in which toner contains an externally added agent such as silica in order to improve charging ability and fluidity.

However, there was a problem that, when a developing device used the aforementioned developer, in a period between when the developing device was manufactured and when the developing device is used, in other words, when the developing device is not in use, silica or the like, which is used as an externally added agent, becomes isolated from the toner. The isolated silica or the like agglomerates at a location where the feeding roller contacts the developing roller, which results in white bands appearing on the printing medium.

Hence, an object of the present application is to provide a developing device that can avoid the problem of white bands appearing on the printing medium when the externally added agent agglomerates between the feeding roller and the developing roller.

SUMMARY

In order to solve the abovementioned problem, the developing device of the present application includes a developing member for developing an electrostatic latent image by adhering developer on an image carrier; a feeding member for feeding the developer to the developing member; and an interposing member that is interposed between the developing member and the feeding member during a period of when the developing device is not being used.

Accordingly, the feeding member does not contact the developing member because of the interposing member during a period when the developing device is not being used. Thus, even when the externally added agent isolates from the developer that adheres on a surface of the feeding member and agglomerates, the agglomerated externally added agent does not adhere to the developing member surface during a period between when the developing device was manufactured and when the developing device is used. Thus, horizontal spot bands do not occur on the printing medium of the printed recording sheet or the like according to the present developing device.

Another aspect of the device is that the interposing member is a powder.

Thus, horizontal bands do not occur on the printing medium of the printed recording sheet or the like according to the present developing device.

Another aspect of the device is that the powder is silica, which is added to toner to form the developer, and the silica's isolation ratio from the toner is less than or equal to 2.7%.

According to the abovementioned structure, when the isolation ratio of silica from the toner is less than or equal to 2.7%, isolation of silica from toner does not occur. In other words, during a period between when the developing device was manufactured and when the developing device is used, silica does not isolate from the toner and agglomerate at a location where the feeding roller contacts the developing roller, and the problem of horizontal spot bands appearing on the printing medium of the recording sheet or the like does not occur.

Another aspect of the device is that the powder is composed of at least one of zinc stearate, oxidized aluminum and titanium dioxide.

Accordingly, since one of zinc stearate, oxidized aluminum and titanium dioxide or a combination of these materials is interposed as an interposing member, even when the feeding member does not contact the developing member, and the externally added agent is isolated from the developer that is adhered on the surface of the feeding member and agglomerates during the non-usage period, the agglomerated externally added agent does not adhere to the developing member surface. Moreover, as either one of zinc stearate, oxidized aluminum and titanium dioxide or a combination of these materials is difficult to agglomerate, and even when these are interposed, the possibility of agglomeration on the developing member surface is low, and does not cause white bands to appear on the printing medium.

Another aspect of the device is that the interposing member is a flexible sheet member that is removably sandwiched between the developing member and the feeding member.

According to the abovementioned structure, the feeding member does not contact the developing member due to the flexible sheet member. Thus, even when the externally added agent is isolated from the developer that adheres on the surface of the feeding member and agglomerates, the agglomerated externally added agent does not adhere on the developing member surface during a period between when the developing device is manufactured and when the developing device is used. Moreover, when the developing device is to be used, the flexible sheet member is simply removed. Therefore, there is no possibility that white bands will appear on the printing medium.

Another aspect of the device is that the interposing member is a flexible sheet member, and the flexible sheet member is removably sandwiched between the developing member and the image carrier.

According to the abovementioned structure, it is possible to avoid scarring the part of the developing member that contacts the latent image carrier caused by the mutual contact. Therefore, it is possible to provide a developing device that is less likely cause image defects.

Another aspect of the device is that the flexible sheet member is a resin film.

According to the abovementioned structure, it is difficult for the surfaces of the developing member and the feeding member that sandwich the resin film to scar. Thus, it is possible to provide an image developing device in which image defects hardly occur.

Another aspect of the invention is that the developing device is part of an image forming device.

Accordingly, it is possible to provide an image forming device in which the externally added agent that is isolated from toner does not agglomerate at the contacting part of the feeding roller and the developing roller between the time when the developing device was manufactured and the time when the developing device is used, and there is no possibility of white bands appearing on the printing medium.

Accordingly, the present application can provide a developing device in which an externally added agent that is isolated from toner does not agglomerate at a location where the feeding roller contacts the developing roller, and there is no possibility of the white bands appearing on the printing medium.

Figure 1:
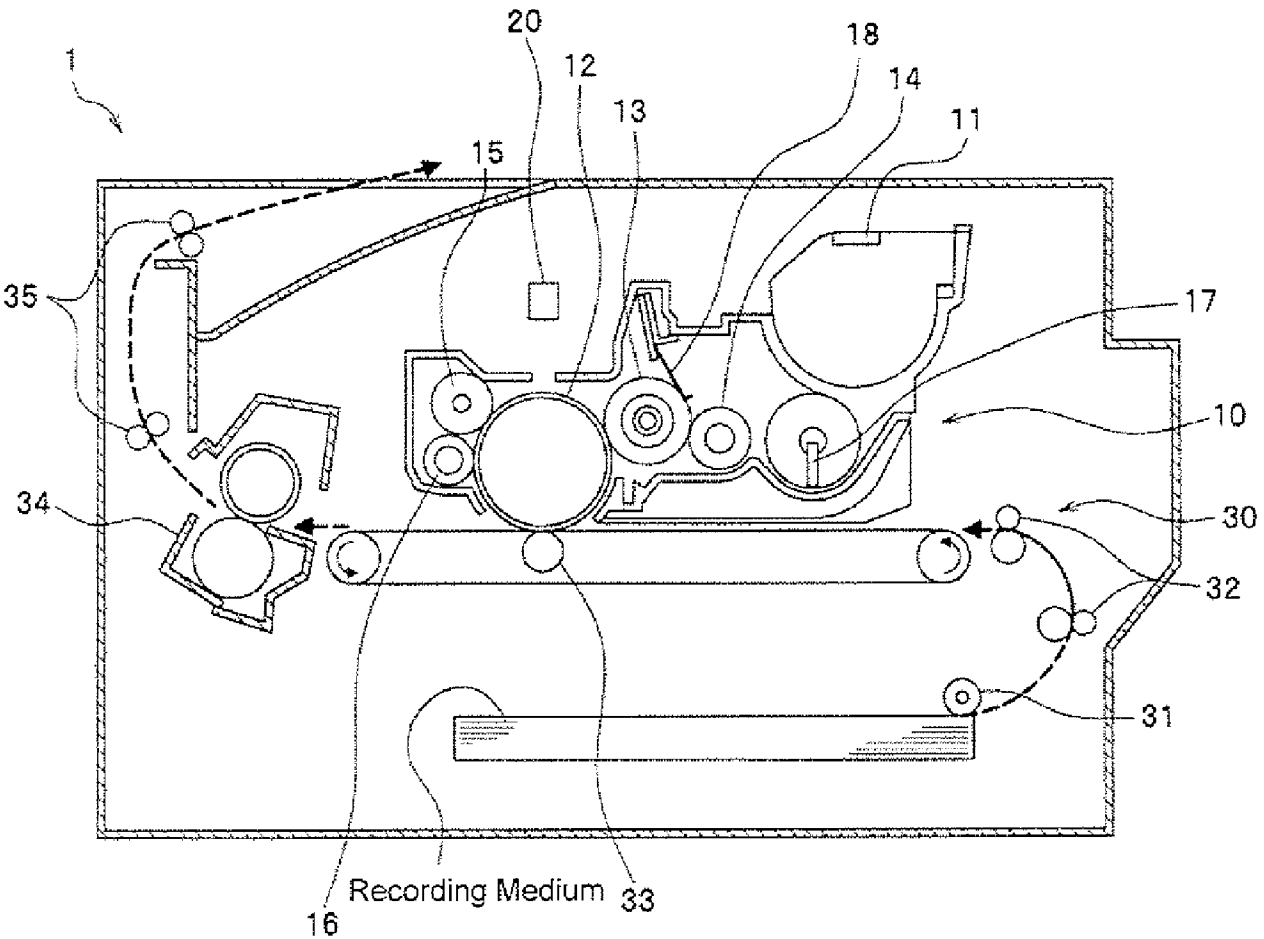
FIG. 1 is a side sectional view illustrating an inside of the developing device and the image forming device of an embodiment.

DETAILED DESCRIPTION (Image Forming Device 1) The image forming device 1 shown in FIG. 1 is a device to form a black and white images on a medium such as recording sheet or the like. The image forming device 1 is formed from at least a developing device 10 for forming an image to be transferred to the recording sheet, an exposing device 20 for irradiating light corresponding to the image formed by the developing device 10, and a conveying apparatus 30 for carrying the recording sheet. The medium for forming an image as a recording sheet is explained hereafter.

(Developing Device 10) The developing device 10 shown in FIG. 1, in order to form an image to be transferred to the recording sheet, is formed from a toner cartridge 11 (or developer cartridge) for containing a developer T, a photoreceptor drum (latent image carrier) 12 for carrying an electrostatic latent image, a developing roller 13 for developing (or creating) a developer image by adherence of the developer T on the electrostatic latent image that is carried by the photoreceptor drum 12, a feeding roller (feeding member) 14 for feeding the developer T that is contained in the toner cartridge 11 to the developing roller 13, a charge roller 15 for charging a surface of the photoreceptor drum 12, a cleaning roller 16 for removing the developer T that remains on the surface of the photoreceptor drum 12, a toner sensor 17 for detecting a remaining amount of the developer T that is contained in the toner cartridge 11 and a layer forming blade 18 for leveling the developer T that is adhered on the developing roller 13 to a thin layer.

On the developing roller 13 that is shown in FIG. 1, a semi-conductive silicon rubber layer, which has ultraviolet treated conductive shaft, is formed. Also, a surface coating layer that is formed by applying urethane type resin on the surface of the silicon rubber layer and a silane coupling layer are also formed. Silica particles are mixed on the surface coating layer in order to make the surface rough. The surface roughness of the surface coating layer is Rz=3–12 μm (Japanese Industrial Standard (JIS): B0601-1994). It is preferable to have large value of Rz in order to maintain a high printing density.

The feeding roller 14 shown in FIG. 1 is formed so that a semi-conductive silicon layer is formed with a predetermined diameter on the conductive shaft. The silicon layer is made of a variety of gums (rubbers) such as dimethyl-silicon raw gum and methyl phenyl-silicon raw gum in which reinforcing silica filler, vulcanizing agent and foaming agent are provided for strengthening elasticity.

(Developer T) The developer T of the present embodiment is made by externally adding powder to toner. The toner is made of conductive plastic particles. It is noted that these embodiments are merely examples of the invention, and do not limit the scope of the attached claims. On the other hand, the powder used in the present embodiment may be made of silica. Or, the powder may be made of one of zinc stearate, oxidized aluminum and titanium dioxide. Further, the powder may be made of a combination of all of or some of these materials. Zinc stearate, oxidized aluminum and titanium dioxide do not agglomerate easily.

Moreover, a mixer or the like is used for mixing the toner and the powder when manufacturing the developer. Here, isolation ratio of the powder varies depending on a rim speed of the mixer (m/s), the rotation period (s) or the like. Generally, the isolation ratio decreases in proportion to the mixing time. When silica is used as the powder, it is necessary to mix until the isolation ratio from the toner is less than or equal to 2.7%. Herein, the isolation ratio is defined by simultaneous illuminations by carbon atoms that are constituent elements of toner bonding resin and by atoms of the externally added agent. The isolation ratio can be calculated by using the formula 1 below.

[Formula 1]

$$\text{Isolation Ratio} = \frac{\left(\begin{array}{c}\text{Number of atoms that did not}\\ \text{illuminate at the}\\ \text{same time with atom } C\end{array}\right)}{\left(\begin{array}{c}\text{Number of atoms that did illuminate}\\ \text{at the same time with atom } C +\\ \text{Number of atoms that did not}\\ \text{illuminate at the}\\ \text{same time with atom } C\end{array}\right)} \times 100(\%) \quad (1)$$

For example, toner powder for the sampling is sent to a helium plasma atmosphere that is generated in a particle analyzer system particle by particle. In the analyzer system, each sent particle is excited so that the particle illuminates. Using the illumination of the particles, the particles are measured by a spectroscopic analysis. The carbon atoms are measured at one channel (channel 1). The atoms of the externally added agent are measured at another channel (channel 2). Such a sampling process is performed such that the count of the illuminated carbon atoms reaches a predetermined value (500 to 1500) by one scanning process. In the process, types of the atoms are determined based on an illuminating spectrum wavelength. Examples regarding the isolation ratio are described in later embodiments. On the other hand, when zinc stearate, oxidized aluminum and titanium dioxide, which do not agglomerate when the power is isolated, are used, the mixing time or the like is not limited as there is no isolation ratio involved.

(Exposing Device 20) An exposing device 20 is an exposing means for forming an electrostatic latent image on a photoreceptor drum by radiating a laser based on the image information. The exposing device 20 irradiates the surface of the photoreceptor drum 12 of the developing device 10.

(Conveying Apparatus 30) A conveying apparatus 30 is a mechanism to carry the recording sheet in the direction indicated by the broken-line arrow shown in FIG. 1. In detail, the conveying apparatus 30 is formed from a feed roller 31 for feeding a recording sheet that is loaded in a storing tray, a registration roller 32 for carrying the recording sheet to a transferring position, a transferring roller 33 for transferring the developer image on the recording sheet by sandwiching the recording sheet with the photoreceptor drum 12, a fusing roller 34 for fusing the developer image that is transferred on the recording sheet and drive rollers 35 for conveying the recording sheet on which the developer is adhered to an ejecting outlet.

Since the developing device 10 uses the developer T in which silica with an isolation ratio less than or equal to 2.7% from toner as the powder is added, there is no possibility that the silica will isolate from the toner. In other words, because silica isolated from the toner does not agglomerate at the contacting part of the feeding roller 14 and the developing roller 13, the developing roller 13 can properly feed the developer T that is fed from the feeding roller 14 to the photoreceptor drum 12; therefore, the problem of horizontal spot bands does not occur on the recording sheet.

When zinc stearate, oxidized aluminum and titanium dioxide are used in the developer T, such materials like hardly ever agglomerate. In other words, the developing roller 13 can properly feed the developer T that is fed from the feeding roller 14 to the photoreceptor drum 12 at the time of using the developing device 10 without the powder of zinc stearate or the like being agglomerated at the contacting part of the feeding roller 14 and the developing roller 13; therefore horizontal spot bands do not occur on the recording sheet.

Other Embodiments

The present application is not limited to the above described developing device 10. Other developing devices 10A and 10B are shown in FIGS. 2A, 2B, 3A-3E and 4A-4E.

Figure 2A:
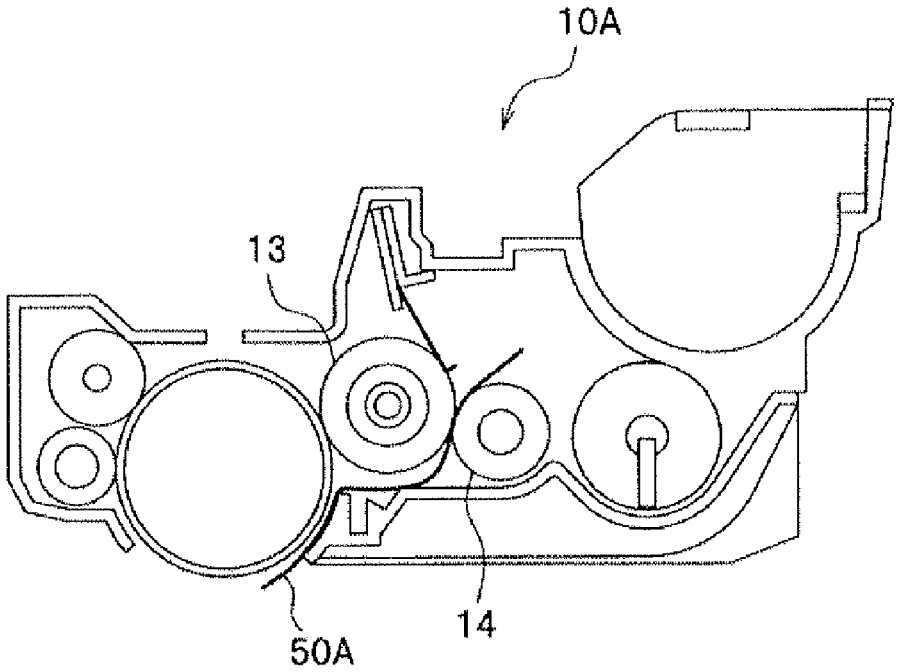
FIG. 2A is a side sectional view illustrating an inside of the developing device of one embodiment.

The difference between the developing device 10 of the first embodiment and the developing device 10A shown in FIG. 2A is that a resin sheet (flexible sheet) 50A is located between the developing roller 13 and the feeding roller 14. Because the resin sheet 50A is located between the developing roller 13 and the feeding roller 14, the developing roller 13 and the feeding roller 14 are apart. Therefore, even when the externally added agent, such as silica, is isolated from the developer T that adheres on the surface of the feeding roller 14 during the period of non-use, since it does not agglomerate by adhering on the surface of the developing roller 13, horizontal spot bands do not occur on the printing medium.

Figure 2B:
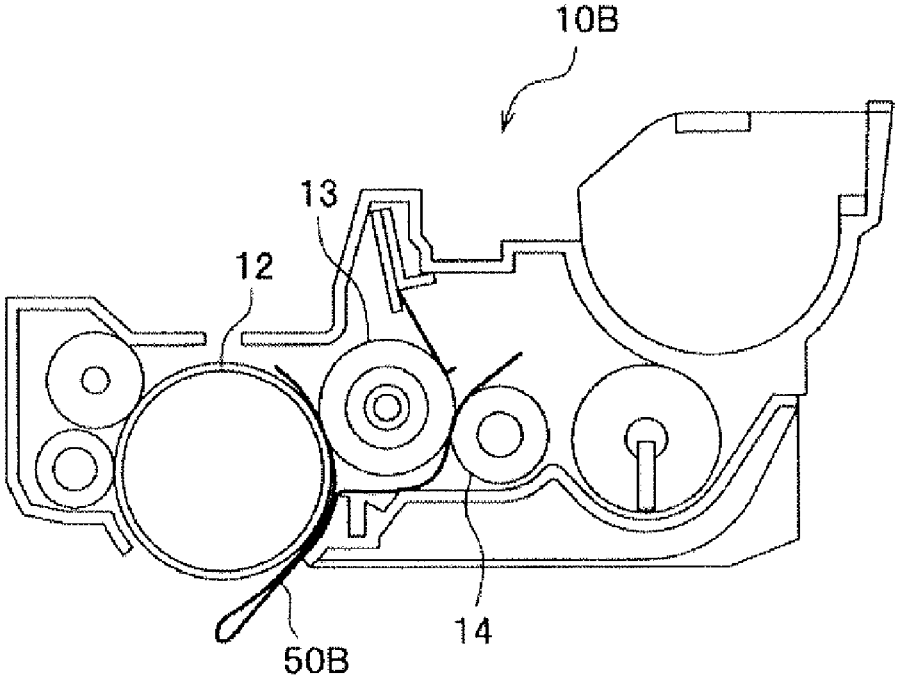
FIG. 2B is a side sectional view illustrating an inside of the developing device of another embodiment.

The developing device 10B shown in FIG. 2B is a modified example of the developing device 10A of FIG. 2A. In the developing device 10B, a resin sheet 50B is located not only between the developing roller 13 and the feeding roller 14, but also between the photoreceptor drum 12 and the developing roller 13. Therefore, horizontal spot bands do not occur on the printing medium. Further, the developing device 10B avoids scarring caused by contact between the members because the resin sheet 50B is located at the contacting part of the developing roller 13 and the photoreceptor drum 12. Therefore, the developing device 10B reliably produces high quality images.

The resin sheets 50A and 50B are formed from polyethylene terephthalate (PET), polypropylene (PP) or the like. It is preferable to use materials that are less likely to cause chemical reactions with the materials forming the developing roller 13, the feeding roller 14 or the like.

The assembling method of the developing device 10A which is equipped with the resin sheet 50A is described below with reference to FIGS. 3A and 3E.

Figure 3A:
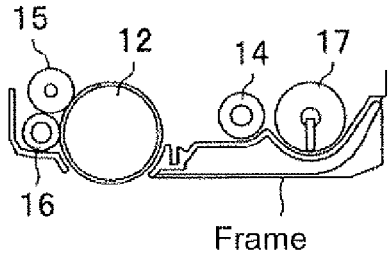
FIGS. 3A-3E illustrate an assembling process of the developing device that has a resin sheet.
Figure 3D:
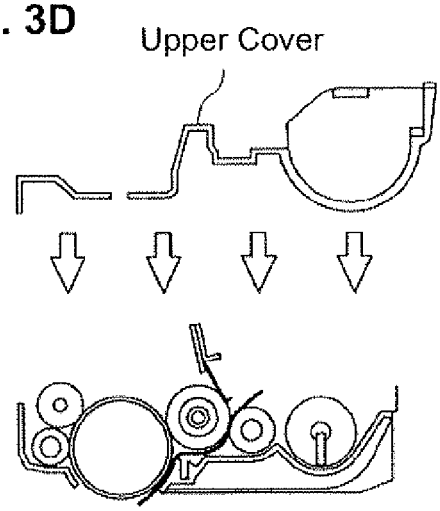

Initially, as shown in FIG. 3A, the toner sensor 17, the feeding roller 14, the photoreceptor drum 12, the cleaning roller 16 and the charge roller 15 are assembled respectively inside of a frame, which forms a shell of the developing device 10A.

Figure 3B:
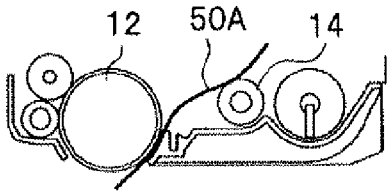

Subsequently, as shown in FIG. 3B, one end of the resin sheet 50A is inserted between the photoreceptor drum 12 and the frame. The other end of the resin sheet 50A is arranged on the upper side of the feeding roller 14 so that the resin sheet 50A covers the surface of the feeding roller 14.

Figure 3C:
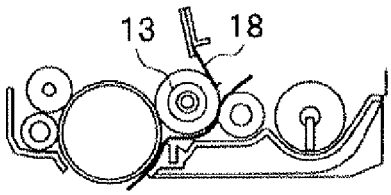
Figure 3E:
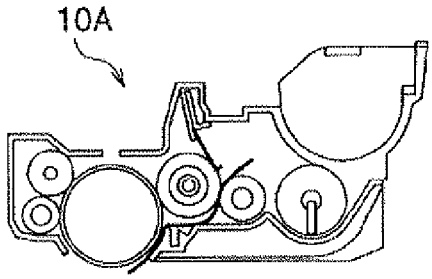

Then, as shown in FIG. 3C, the developing roller 13 is assembled on the frame so that the resin sheet 50A is sandwiched between the feeding roller 14 and the developing roller. Then, the layer forming blade 18 is assembled on the frame. By doing this, the resin sheet 50A is located between the developing roller 13 and the feeding roller 14. If the resin sheet 50A is wrinkled when sandwiched by the developing roller 13 and the feeding roller 14, it is preferable to pull both ends of the resin sheet 50A outward. In other words, tension should be applied to the resin sheet 50A to remove any wrinkles. This is to prevent a wrinkle of the resin sheet 50A from pressing the layer formed on the surface of the developing roller 13 or the feeding roller 14.

Lastly, as shown in FIG. 3D, an upper cover is assembled on the frame. As shown in FIG. 3E, this completes the developing device 10A, which is equipped with the resin sheet 50A.

The assembling method of the developing device 10B, which is equipped with the resin sheet (flexible sheet member) 50B, is described below with reference to FIG. 4.

Figure 4A:
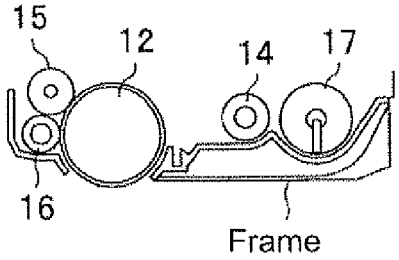
FIGS. 4A-4E illustrate an assembling process of the developing device that has a resin sheet.

Initially, as shown in FIG. 4A, the toner sensor 17, the feeding roller 14, the photoreceptor drum 12, the cleaning roller 16 and the charge roller 15 are assembled respectively inside of a frame, which forms a shell of the developing device 10A.

Figure 4D:
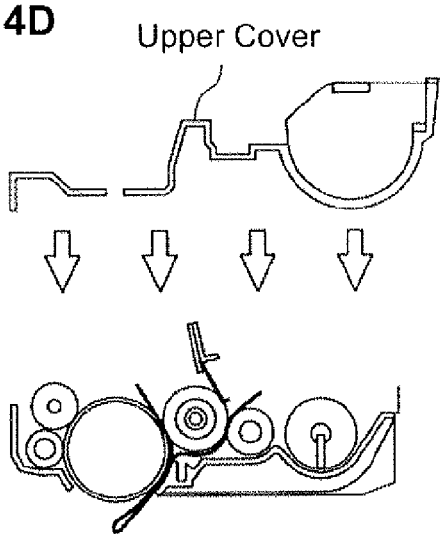
Figure 4B:
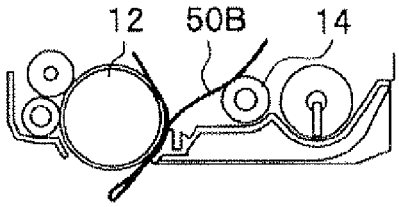

Subsequently, as shown in FIG. 4B, the resin sheet 50B is bent, and the end part created by bending is inserted between the photoreceptor drum 12 and the frame. At this point, the other end of the resin sheet 50B is arranged so that one end covers the surface of the feeding roller 14. The other end of the resin sheet 50B covers the surface of the photoreceptor drum 12, as shown.

Figure 4C:
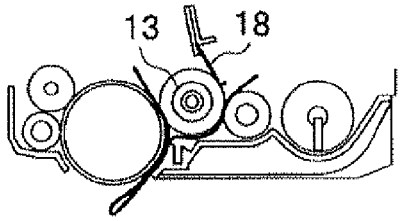

Then, as shown in FIG. 4C, the developing roller 13 is assembled on the frame so that one end of the resin sheet 50B is sandwiched between the feeding roller 14 and the developing roller 13, and the other end of the resin sheet 50B is sandwiched between the photoreceptor drum 12 and the developing roller 13. Then, the layer forming blade 18 is assembled on the frame. By doing this, the resin sheet 50B is located between the developing roller 13 and the feeding roller 14. Further, as described above, if the resin sheet 50B is wrinkled, it is preferable to pull the end formed by bending the resin sheet 50B slightly downwards while lightly supporting both ends of the resin sheet 50B. In other words, tension should be applied to the resin sheet 50B to remove any wrinkles.

Figure 4E:
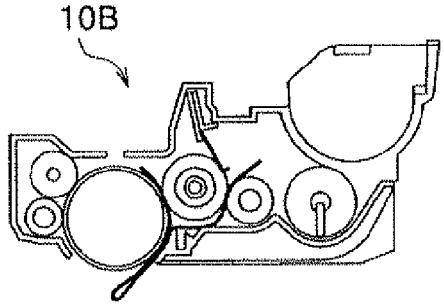

Lastly, as shown in FIG. 4D, an upper cover is assembled on the frame. As shown in FIG. 4E, this completes the developing device 10B, which is equipped with the resin sheet 50B.

Since the resin sheets 50A and 50B that are assembled in the developing devices 10A and 10B are readily removable, the flexible sheet member 50A, 50B can be simply be removed when using the respective developing device 10A, 10B. Even when the externally adding agent that is added to the toner is agglomerated during a period between when the developing device was been manufactured and when the developing device is used, it does not adhere on the developing member surface.

These embodiments are merely examples of the invention, and do not limit the scope of the attached claims. For example, the image forming device 1 uses a direct print method; however, a so-called intermediate transferring method can be also used. In addition, a color image forming device that is formed from a plurality of developing devices can be used instead of a simple black and white image forming device.

First Through Third Embodiments

Silica is used as an externally added agent for the developer of the present application. Experiments were performed under the condition where the isolation ratio was 1.8% (first embodiment), 2.3% (second embodiment) and 2.7% (third embodiment), respectively. Hereafter, the developers used in the embodiments are described in detail.

The developers used in the first to third embodiments were obtained as follows:

(1) low-molecular-weight polyethylene 2 pts. wt. (parts by weight) as an offset preventing agent/inhibitor; Aizen Spilon Black TRH (Hodogaya Chemical Co., Ltd.) 1 pts. wt. as a charge-controlling agent; Carbon Black (manufactured by Printe L Degussa AG) 6 pts. wt.; and 2,2'-azobisisobutyronitrile 1 pts. wt. were added to styrene 77.5 pts. wt. and acrylic acid n-butyl 22.5 pts. wt, and this agent was set in an Atrider (MA-01SC, manufactured by Mitsui Miike Machinery Co. Ltd.) under a temperature of 15° C., then dispersed for 10 hours, and a polymerized composition was obtained.

(2) Dispersion media for polymerization was prepared by preparing ethanol 180 pts. wt. in which polyacrylic acid 8 pts. wt. and divinylbenzene 0.35 pts. wt. were dissolved, and distilled water 600 pts. wt. was added to this.

(3) Subsequently, the polymerized composition was added to this dispersion media, and dispersed for 10 minutes under a temperature of 15° C. and for 8000 rotations per minute (rpm) using TK Homomixer (Type M, manufactured by Tokushu Kikai Co., Ltd.). (4) Next, the obtained dispersed solution was reacted at 85° C. for 12 hours while stirring the obtained dispersed solution under nitrogen ventilating air at 100 rpm. The dispersed material that was obtained by the polymerizing reaction of the polymerized composition up to this point is called intermediate particle.

(5) In a water type suspending solution of the intermediate particle, water emulsion A that was formed from methyl methacrylate 9.25 pts. wt., acrylic acid n-butyl 0.75 pts. wt., 2,2'-azobisisobutyronitrile 5 pts. wt., sodium lauryl sulfate 0.1 pts. wt. and water 80 pts. wt. was fixed by using ultrasonic oscillator (US-150, manufactured by Nippon Seiki Kaisha Ltd.). Then, this water emulsion A 9 pts. wt. was instilled, and the intermediate particle was swelled.

(6) Moreover, as the second polymerization, the disperse solution was reacted for 10 hours under a temperature of 85° C. while stirring under nitrogen. After it was cooled, the polymerized composition was dissolved in 0.5 N hydrochloride water solution, and after being filtered and washed by water and air-dried, the composition was dried under a reduced pressure of 10 mmHg for 10 hours at 40° C. Then, the composition was classified by a wind power classifier, then the toner of its volume average particle diameter of 7.0 nm. The obtained volume average particle diameter of the toner was obtained by performing 30,000 count measurement with the aperture diameter of 100 μm by using a cell count analyzer known as a Coulter Multisizer 3 (manufactured by Beckman Coulter Co. Ltd.).

(7) The hydrophobic treated Silica 0.8 pts. wt. (product name: RX200; manufactured by Degussa AG) with the particle diameter of 12 nm was added to this toner 100 pts. wt. Further, silane coupling agent treated titanium oxide 1.0 pts. wt. (product name: "TAF-110P", particle diameter 50 nm, manufactured by Fuji Titanium Industry Co., Ltd.) was added.

(8) Then, after the silica and the titanium oxide were added to the toner, it was mixed until the isolation ratio becomes 1.8% (first embodiment), 2.3% (second embodiment) and 2.7% (third embodiment), respectively. In detail, the rim speed was increased from 0 to 40 m/s in 5 seconds, and after the rim speed of 40 m/s was reached, it was mixed for 30 seconds while maintaining the rim speed. Next, the rim speed was reduced to 0 m/s in 5 seconds, and left in that condition for 30 seconds. This kind of cycle is 1 cycle, and the developer with an isolation ratio of 2.7% described in the third embodiment was manufactured by performing a total of 5 cycles. The developers described in the first and second embodiments were manufactured by increasing the mixing time as compared to that of the third embodiment in order to reduce the isolation ratio. The isolation ratio was measured by using a particle analyzer (DP-1000; manufactured by ORIBA Co., Ltd.). The measurement conditions were as follows: detecting numbers of carbon atom at one measurement: 500-1500, noise cut level: less than or equal to 1.5V, sort time: 20 digits, $O_2$ gas: 0.1%, He gas, analytical wavelength carbon atom (C): 247.68 nm and Silicon (Si): 334.98 nm.

First and Second Comparative Examples

Moreover, after the silica and the titanium oxide that were obtained though the processes of (1)-(7) were added to the toner, it was mixed so that the isolation ratio will be 3.0% (First comparative example), and 5.0% (Second comparative example).

Figure 5:
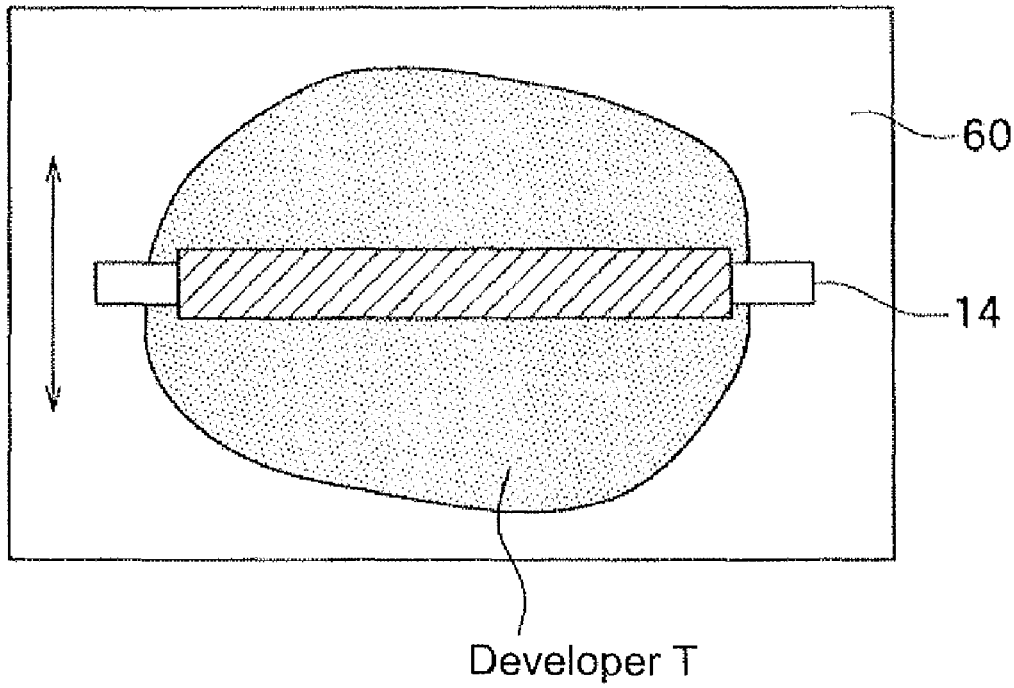
FIG. 5 illustrates a method for adhering silica on the feeding roller of the embodiment.

(Experiment Method) Subsequently, the examination method is explained using FIG. 5. (1) First of all, as shown in FIG. 5, the developer of the first to third embodiments and the first and second comparative examples were evenly laid out on the surface of a flat plate 60. Next, the developer was adhered on the surface of the feeding roller 14 by rolling the developer T which is laid out on the surface of the flat plate 60 by its own weight of the feeding roller. Then, the feeding roller 14 which has the developer adhered on the surface was assembled in the developing device 10. Moreover, the developing device 10 is in the condition that the toner cartridge 11 is being removed.

(2) The developing device 10 was left under the environment of room temperature 25±2° C., and humidity 50±10% for two months.

(3) After this, the designated toner cartridge 11 was attached to the developing device 10 that was left for two months, and it was installed in the image forming device 1, then a solid black image was printed on the entire recording sheet to confirm whether or not silica was isolated and agglomerated from the developer by checking whether or not the spot occurred on the recording sheet. Moreover, the developer that is designated by the manufacture of the image forming device 1 was used for the developer contained in the toner cartridge 11. Moreover, the printing condition was −300V to the developing roller 13, −450V to the feeding roller 14 and the layer forming blade and +800V for the transferring roller 33. As for at the time of printing operation, the rim speed of the photoreceptor drum 12 is 162 mm/s, and the rim speed ratio of the developing roller 13 and the feeding roller 14 with respect to the photoreceptor drum 12 was 1.237 and 0.643, respectively. Moreover, a nip width of the developing roller 13 with respect to the photoreceptor drum 12 was 0.18±0.03 mm.

(Experimental Results) The results of the experiment are shown in Table 1.

TABLE 1

| | Name of Specimen (Isolation Ratio [%]) | | | | |
|---|---|---|---|---|---|
| | First Embodiment (1.8%) | Second Embodiment (2.3%) | Third Embodiment (2.7%) | Fourth Embodiment (3.0%) | Fifth Embodiment (5.0%) |
| Image Evaluation | ○ | ○ | ○ | X | X |

The developing device which includes the feeding roller 14 which has the developer is adhered according to the first and second comparative examples, on the printed recording sheet, approximately 4 mm width of horizontal spot band occurred as the same interval as the rotation cycle of the developing roller 13. In other words, the horizontal spot band is caused because the silica of the developer according to the first and second comparative example was isolated and agglomerated at the contacting part of the developing roller 13, and the developer T in the toner cartridge 11 was not carried correctly.

On the other hand, when printing was performed by using the image forming device 1 includes the feeding roller 14 which the developer was adhered according to the first to third embodiments, the entire recording sheet was printed in black. As a result, with the developing device includes the feeding roller 14 in which the developer was adhered according to the first to third embodiments, the silica was not agglomerated at the contacting part of the developing roller 13 and the feeding roller. This indicates that the developer T in the toner cartridge 11 was correctly carried.

Moreover, by using the developing device according to the first and second comparative examples in which a spotted image or missing image occurred, an ISO evaluation pattern was performed on A4 size regular size sheets for 100 sheets, then, the solid black image printing was performed again on the entire recording sheet. As a result, the entire recording sheet was black and the spotted image or missing image did not occur. This is because silica that is agglomerated on the surface of the developing roller 13 was brushed off/scraped off by friction with the feeding roller 14 and the photoreceptor drum while printing 100 sheets. Therefore, with the developing device includes the feeding roller 14 where the developer is adhered according to the first and second comparative examples, the horizontal spot band that occurred on the recording sheet is the agglomerated silica.

Accordingly, if the silica added to the toner has the isolation ratio of less than or equal to 2.7%, it was confirmed that the silica does not get agglomerated at the contacting part of the feeding roller 14 and the developing roller 13, and the problem that the horizontal band occurs on the printing medium does not occur.

Fourth-Sixth Embodiments

For the fourth embodiment, zinc stearate (SZ-2000 manufactured by Sakai Chemical Industry Co., Ltd.), for the fifth embodiment, aluminum oxide (a alumina AM-21 manufactured by Sumitomo Chemical), and for the sixth embodiment, titanium dioxide (EC-100, EC-200 and EC-300 manufactured by Titan Kogyo Ltd.), were used respectively as powder, and performed the examination.

As for the examination method according to the fourth to sixth embodiments, the powder of zinc stearate (fourth embodiment), aluminum oxide (fifth embodiment) and titanium dioxide (sixth embodiment) were directly adhered as much as possible on the entire surface of the feeding roller 14. Then, the feeding roller 14 in which the above-mentioned powder was adhered on the surface was assembled in the developing device 10. Moreover, the developing device 10 is in the condition that the toner cartridge 11 is being removed.

After this, as same manner as the first to third embodiments, the developing device 10 was left under the environment of room temperature 25±2° C. and humidity 50±10% for two months. Then, the designated toner cartridge 11 was attached to the developing device 10 that was left for two months, and was installed in the image forming device 1, then a solid black image was printed on the entire recording sheet, and whether or not silica was isolated and agglomerated from the developer was confirmed by checking whether or not the spot had occurred on the recording sheet.

(Experimental Results) The results of the experiment are shown in Table 2.

TABLE 2

| Name of Specimen | Fourth Embodiment | Fifth Embodiment | Sixth Embodiment |
|---|---|---|---|
| Image Evaluation | ○ | ○ | ○ |

When printing is performed by the image forming device that includes the feeding roller in which the powder is adhered according to the fourth to sixth embodiments, black color was printed entirely on the recording sheet. As a result, it is indicated that even if the developing device that includes the feeding roller in which the powder is adhered according to the fourth to sixth embodiments, when the powder according to the fourth to sixth embodiments is used, it does not get agglomerated at the contacting part of the developing roller and the feeding roller, and the developer T in the toner cartridge 11 correctly carried on the surface of the photoreceptor drum 12.

Accordingly, when the powder is formed from zinc stearate, aluminum oxide and titanium dioxide, the agglomeration of the powder does not occur at the contacting part of the developing roller and the feeding roller, and the problem of horizontal spot band on the printing medium can be avoided.

What is claimed is:

1. A developing device comprising;

an image carrier on which an electrostatic latent image is formed;

a developing member for developing the electrostatic latent image by adhering developer on the image carrier;

a feeding member for feeding the developer to the developing member;

a frame accommodating the image carrier, the developing member and the feeding member; and a single flexible sheet used in a bent state and including a first end, a second end and a bent part, wherein the first end is removably located between the developing member and the feeding member to prevent the developer from entering between the developing member and the feeding member before a first usage of the developing device, the second end is removably located between the developing member and the image carrier, the bent part extends outwardly from between the image carrier and the frame so that the bent part is exposed outside the frame, and the flexible sheet is removed immediately prior to the first usage.

2. The developing device according to claim 1, wherein the flexible sheet is made of resin material.

3. The developing device according to claim 2, wherein the resin material is one of polyethylene terephthalate (PET) and polypropylene (PP).

4. The developing device according to claim 1, wherein the developing device is part of an image forming device.

* * * * *